United States Patent [19]

Sahm

[11] Patent Number: 5,065,326

[45] Date of Patent: Nov. 12, 1991

[54] AUTOMATIC EXCAVATION CONTROL SYSTEM AND METHOD

[75] Inventor: William C. Sahm, Peoria, Ill.

[73] Assignee: Caterpillar, Inc., Peoria, Ill.

[21] Appl. No.: 394,919

[22] Filed: Aug. 17, 1989

[51] Int. Cl.[5] ..... G06F 15/20; E02F 3/34

[52] U.S. Cl. ..... 364/424.07; 414/699; 37/DIG. 1; 340/686

[58] Field of Search ..... 364/424.07, 508, 559; 37/103, DIG. 1, DIG. 19, DIG. 20; 340/684, 686; 414/699, 708; 280/764.1; 172/4.5

[56] References Cited

U.S. PATENT DOCUMENTS

| | | | |
|---|---|---|---|
| 3,636,325 | 1/1972 | Chytil | 235/151 |
| 3,831,683 | 8/1974 | Ikeda et al. | 172/4.5 |
| 4,377,043 | 3/1983 | Inui et al. | 37/18 R |
| 4,791,549 | 12/1988 | Heiser et al. | 364/167.01 |
| 4,805,086 | 2/1989 | Nielsen et al. | 364/167.01 |
| 4,807,131 | 2/1989 | Clegg | 364/424.01 |
| 4,807,136 | 2/1989 | Ruthowski et al. | 340/684 |
| 4,844,685 | 7/1989 | Sagaser | 414/708 |
| 4,866,641 | 9/1989 | Nielsen et al. | 414/699 |

FOREIGN PATENT DOCUMENTS

| | | | |
|---|---|---|---|
| 0153102 | 8/1985 | European Pat. Off. | 364/424.07 |

*Primary Examiner*—Gary Chin

*Attorney, Agent, or Firm*—Wei W. Jeang; James R. Yee

[57] ABSTRACT

A control system and method automatically controls a work implement of an excavating machine to perform a complete excavation work cycle. In performing the work cycle, the control system automatically extends the work implement down into the trench, completes a dig stroke, captures the excavated material, swings the work implement to dump, dumps the load, returns the work implement to the trench, and repeats the work cycle until a trench is excavated according to operator programmed specifications. The control system monitors the position of the work implement and the forces exerted on the work implement and controllably actuates the work implement according to predetermined position and force setpoints.

28 Claims, 8 Drawing Sheets

40
DISPLACEMENT SENSOR
46
PRESSURE SENSOR
42
DISPLACEMENT SENSOR
48
PRESSURE SENSOR
44
DISPLACEMENT SENSOR
50
PRESSURE SENSOR
28
BOOM CYLINDER
30
STICK CYLINDER
32
BUCKET CYLINDER
57
HYDRAULIC CONTROL VALVE
58
HYDRAULIC CONTROL VALVE
59
HYDRAULIC CONTROL VALVE
52
SIGNAL CONDITIONER
9
38
LOGIC MEANS
54
CONTROL LEVER
56
OPERATOR INTERFACE

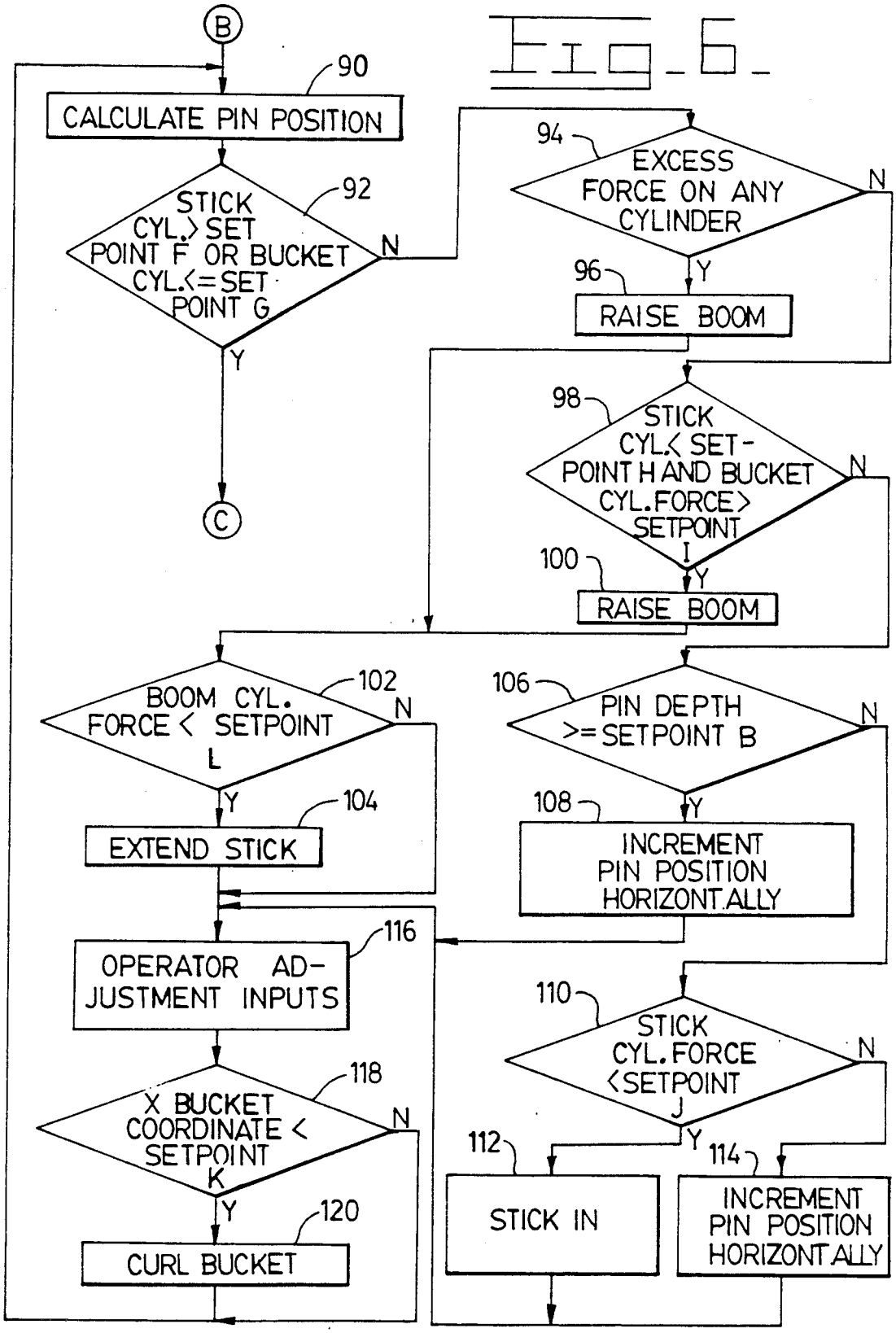
Fig. 6
B
90
CALCULATE PIN POSITION
92
STICK CYL.> SET POINT F OR BUCKET CYL.<=SET POINT G
N
Y
C
94
EXCESS FORCE ON ANY CYLINDER
N
Y
96
RAISE BOOM
98
STICK CYL.< SET-POINT H AND BUCKET CYL.FORCE> SETPOINT I
N
Y
100
RAISE BOOM
102
BOOM CYL. FORCE < SETPOINT L
N
Y
104
EXTEND STICK
106
PIN DEPTH >=SETPOINT B
N
Y
108
INCREMENT PIN POSITION HORIZONTALLY
116
OPERATOR AD-JUSTMENT INPUTS
118
X BUCKET COORDINATE < SETPOINT K
N
Y
120
CURL BUCKET
110
STICK CYL. FORCE <SETPOINT J
N
Y
112
STICK IN
114
INCREMENT PIN POSITION HORIZONTALLY

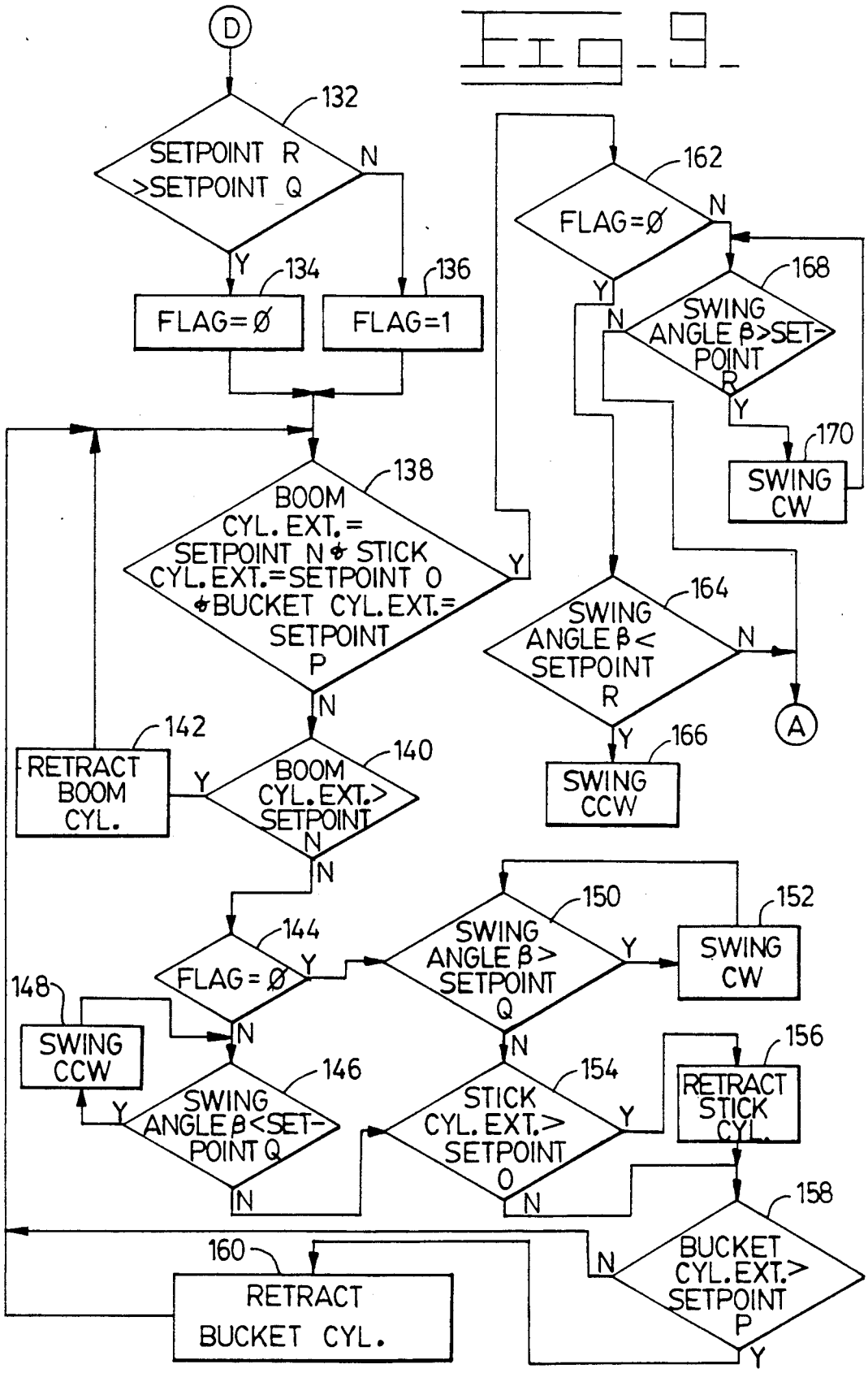
FIG. 9
D
132
SETPOINT R >SETPOINT Q
N
Y
134
FLAG=Ø
136
FLAG=1
138
BOOM CYL. EXT.= SETPOINT N & STICK CYL. EXT.=SETPOINT O & BUCKET CYL. EXT.= SETPOINT P
Y
N
140
BOOM CYL. EXT.> SETPOINT N
Y
142
RETRACT BOOM CYL.
N
144
FLAG=Ø
Y
N
146
SWING ANGLE β<SET-POINT Q
Y
N
148
SWING CCW
150
SWING ANGLE β> SETPOINT Q
Y
N
152
SWING CW
154
STICK CYL. EXT.> SETPOINT O
Y
N
156
RETRACT STICK CYL.
158
BUCKET CYL. EXT.> SETPOINT P
N
Y
160
RETRACT BUCKET CYL.
162
FLAG=Ø
N
Y
168
SWING ANGLE β>SET-POINT R
N
Y
170
SWING CW
164
SWING ANGLE β< SETPOINT R
N
Y
166
SWING CCW
A

AUTOMATIC EXCAVATION CONTROL SYSTEM AND METHOD

TECHNICAL FIELD

This invention relates generally to the field of excavation and more particularly, to a control system and method which automate the excavation work cycle of an excavating machine.

BACKGROUND ART

Work vehicles such as excavators, backhoes, front shovels, and the like are used for excavation work. These excavating machines have work implements which consist of boom, stick and bucket linkages. The boom is pivotally attached to the excavating machine at one end, and to its other end is pivotally attached a stick. The bucket is pivotally attached to the free end of the stick. Each work implement linkage is controllably actuated by at least one hydraulic cylinder for movement in a vertical plane. Additionally, the work implement is transversely moveable relative to the machine. An operator typically manipulates the work implement to perform a sequence of distinct functions which constitute a complete excavation work cycle.

In a typical work cycle, the operator first positions the work implement at a trench location, and extends the work implement downward until the bucket penetrates the soil. Then the operator executes a digging stroke which brings the bucket toward the excavating machine until the stick is nearly fully retracted. The operator subsequently curls the bucket to capture the soil. To dump the captured load the operator raises the work implement, swings it transversely to a specified dump location, and releases the soil by extending the stick and uncurling the bucket. The work implement is then returned to the trench location to begin the work cycle again. In the following discussion, the above operations are referred to respectively as boom-down-into-trench, dig-stroke, capture-load, swing-to-dump, dump-load, and return-to-trench.

The earthmoving industry has an increasing desire to automate the work cycle of an excavating machine for several reasons. Unlike a human operator, an automated excavating machine remains consistently productive regardless of environmental conditions and prolonged work hours. The automated excavating machine is ideal for applications where conditions are dangerous and unsuitable for humans. An automated machine also enables more accurate excavation with regards to, for example, the trench depth and trench bottom slope, and the added ability to restrict digging in a predefined three dimensional area to avoid destroying utility lines or pipes.

Recent developments have produced a number of machines capable only of automating one or two functions of the excavation work cycle. One such example is described in U.S. Pat. No. 4,377,043 issued power shovel capable of returning a bucket to an original starting position after the operator manually dumps the load. Inui's system does not automate the dig-stroke, capture-load, swing-to-dump, dump-load, and return-to-trench portions of the work cycle.

To excavate and remove soil efficiently, it is desirable to obtain a heaped bucket when digging. The operator must dig and load the soil aggressively and yet simultaneously avoid stalling the hydraulic actuating system of the machine. Experienced operators anticipate stalling by "listening" to the hydraulic system, which emits a telltale noise when overloaded. However, this method has become unreliable with the quieter hydraulic systems of today. An automated excavating machine can anticipate stalling by sensing forces exerted on the work implement, and can take steps to relieve the overload and prevent stalling.

An excavation control apparatus described in Japanese Patent Publication No. Sho 61-9453 and published on Mar. 24, 1986 provides for detect relieving overload conditions encountered during excavation. Once an overload on the work implement is detected, the control apparatus attempts to relieve it by raising the boom for a fixed period of time. This scheme does not relieve all possible overloading conditions encountered during excavation. For example, when the bucket is caught under an obstacle, raising the boom exacerbates the problem. Because the work implement forces are not monitored at this time, the increased force on the stuck work implement is not detected and the boom cylinder hydraulic system may stall as a result. This control apparatus only performs the dig-stroke and capture-load functions of the work cycle.

The present invention automates the work cycle of an excavating machine and is directed to overcoming one or more of the problems as set forth above.

DISCLOSURE OF THE INVENTION

In one aspect of the present invention a control system for automatically controlling a work implement of a machine throughout a machine work cycle is provided. The control system produces a position signal in response to the position of the work implement relative to the machine, and a force signal in response to force exerted on the work implement. A position logic unit receives the position signal, compares it to a plurality of predetermined position setpoints, and produces a responsive position correction signal. A force logic unit receives the force signal, compares it to a plurality of predetermined force setpoints, and produces a responsive force correction signal. An actuating mechanism then receives the position and force correction signals and controllably actuates the work implement to perform the work cycle.

In another aspect of the present invention a method for automatically controlling a work implement of a machine throughout a machine work cycle is provided. The method includes the steps of producing a position signal in response to the position of the work implement relative to the machine, and producing a force signal in response to the force exerted on the work implement. The position signal is received and compared to a plurality of predetermined position setpoints, and a responsive position correction signal is produced. The force signal is received and compared to a plurality of predetermined force setpoints, and a responsive force correction signal is produced. Thereafter the work implement is controllably actuated to perform the work cycle in response to the received position and force correction signals.

The present invention provides a control system and method for controllably actuating a work implement to execute a complete work cycle. The instant control system and method is particularly advantageous in automating the work cycle of an excavating machine.

BRIEF DESCRIPTION OF THE DRAWINGS

For a better understanding of the present invention, reference may be made to the accompanying drawings, in which:

FIG. 6 is a second level flowchart illustrating an embodiment of the dig-stroke function;

FIG. 9 is a second level flowchart illustrating an embodiment of the dump-load function with swing-to-dump and return-to-trench functions.

BEST MODE FOR CARRYING OUT THE INVENTION

Figure 1:
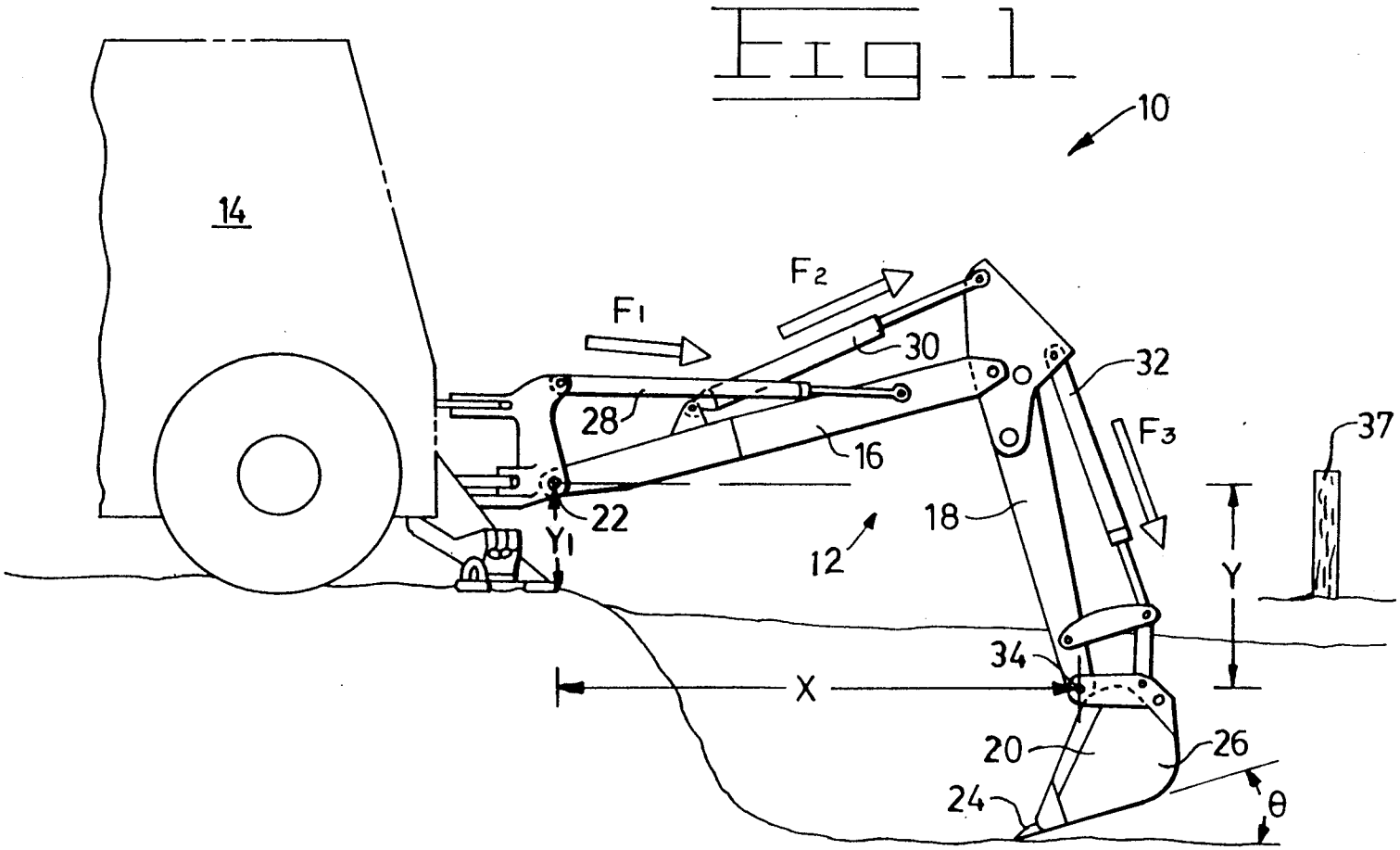
FIG. 1 is a fragmentary side view of an excavating machine.

With reference to the drawings, FIG. 1 shows an automatic excavation control system 10 for controlling a work implement 12 of an excavating machine 14. The excavating machine 14 is shown as a backhoe, but the control system 10 may be implemented on vehicles such as excavators, power shovels and the like. The work implement 12 of such excavating machines generally includes a boom 16, stick 18, and bucket 20. The boom 16 is pivotally mounted on the excavating machine 1 4 by means of a boom pivot pin 22. The stick 18 is pivotally connected to the free end of the boot 16, and the bucket 20 is pivotally attached to the stick 18. The bucket 20 includes a rounded portion 26 and bucket teeth 24.

The boom 16, stick 18 and bucket 20 are independently and controllably actuated by linearly extendable hydraulic cylinders. The boom 16 is actuated by at least one boom hydraulic cylinder 28 for upward and downward movements of the bucket 20. The stick 18 is actuated by at least one stick hydraulic cylinder 30 for longitudinal horizontal movements of the bucket 20. The bucket 20 is actuated by a bucket hydraulic cylinder 32 and has a radial range of motion about a bucket pivot pin 34. For the purpose of illustration, only one boom and one stick hydraulic cylinder 28,30 is shown in FIG. 1.

To ensure an understanding of the operation of the work implement 12 and hydraulic cylinders 28,30,32, the following relationship is observed. The boom 16 is raised by retracting the boom hydraulic cylinders 28 and lowered by extending the same cylinders 28. Retracting the stick hydraulic cylinders 30 moves the stick 18 away from the excavating machine 14, and extending the stick hydraulic cylinders 30 moves the stick 18 toward the machine 14. Finally, the bucket 20 is rotated away from the excavating machine 14 when the bucket hydraulic cylinder 32 is retracted and rotated toward the machine 14 when the same cylinder 32 is extended.

For convenience in description, the horizontal and vertical distances X and Y as measured from the boom pivot pin 22 to the bucket pivot pin 34 are referred to as bucket coordinates X,Y. In addition, a bucket angle 0 describes the bucket pivotal angle with respect to a horizontal plane. Collectively, X,Y,Θ are components of bucket position.

Also shown, but not forming a portion of the invention, is a reference elevation stake 37 which establishes a benchmark elevation from which desired excavation depth is measured. Such method for establishing a reference elevation is well known in the art of surveying for excavation operations. The reference elevation with respect to the excavating machine 14 is conveyed to the automatic excavation control system 10 in the following fashion: a machine operator manipulates the work implement 12 to position the bucket teeth 24 on top of the reference elevation stake 37. From the boom, stick and bucket hydraulic cylinder 28,30,32 extensions, the position of the boom pivot pin 22 with respect to the reference elevation stake 37 is determined. Moreover, the known position of the boom pivot pin 22 establishes the ground level. Therefore, a bucket depth may be computed from the known bucket vertical distance Y, the known ground level, and the fixed distance Y, between the boom pivot pin 22 and ground level.

Figure 2:
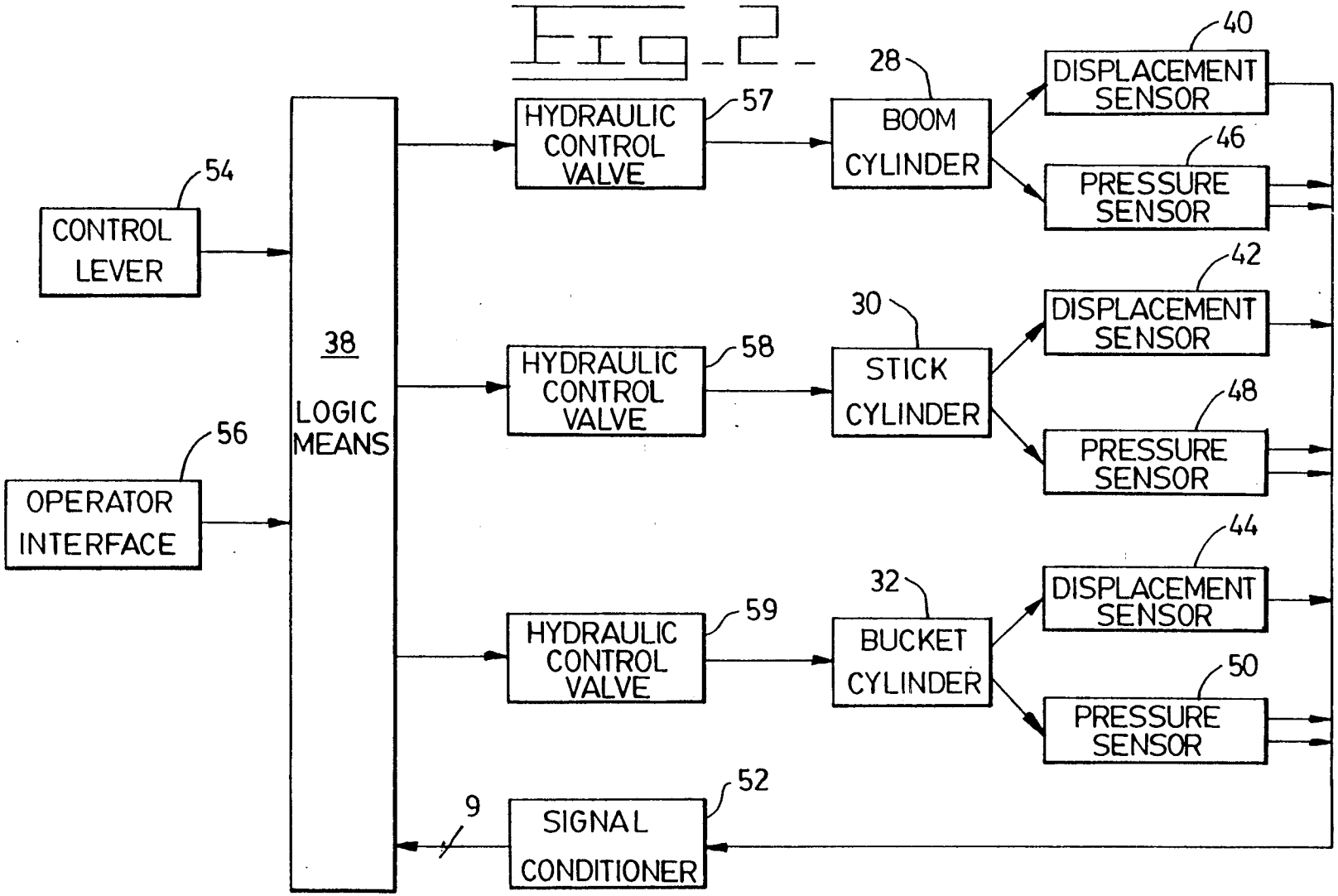
FIG. 2 is a hardware block diagram of an embodiment of the instant invention.

Referring to FIG. 2, means for producing a position signal in response to the position of the work implement 12 includes displacement sensors 40,42,44 for sensing the amount of cylinder extension in the boom, stick and bucket hydraulic cylinders 28,30,32 respectively. One such sensor is the Temposonics Linear Displacement Transducer made by MTS Systems Corporation of Plainview, N.Y. A radio frequency based sensor described in U.S. Pat. No. 4,737,705 issued to Bitar et al. on Apr. 1988 may also be used.

It is apparent that the work implement 12 position is also derivable from the work implement joint angle measurements. An alternative device for producing a work implement position signal includes rotational angle sensors such as rotatory potentiometers, for example, which measure the angles between the boom 16, stick 18 and bucket 20. The work implement position may be computed from either the hydraulic cylinder extension measurements or the joint angle measurement by trigonometric methods. Such techniques for determining bucket position are well known in the art and may be found in, for example, U.S. Pat. No. 3,997,071 issued to Teach on Dec, 14, 1976 and U.S. Pat. No. 4,377,043 issued to Inui et al. on Mar. 22, 1983.

Means for producing a force signal in response to force exerted on the work implement 12 includes pressure sensors 46,48,50 which measure the hydraulic pressures in the boom, stick, and bucket hydraulic cylinders 28,30,32 respectively. The pressure sensors 46,48,50 each produces signals responsive to the pressure differential of the respective hydraulic cylinder 28,30,32. A suitable pressure sensor is the Series 555 Pressure Transducer manufactured by Precise Sensors, Inc. of Monrovia, Calif.

The cylinder extension sensed by the displacement sensors 40,42,44 and the cylinder pressure signals sensed by pressure sensors 46,48,50 are delivered to a signal conditioner 52. The signal conditioner 52 provides conventional signal excitation and filtering. A Vishay Signal Conditioning Amplifier 2300 System manufactured by Measurements Group, Inc. of Raleigh, N.C. may be used for this purpose. The conditioned position and pressure signals are provided as inputs to position and force logic means 38 which include a microprocessor.

The position and force logic means 38 has two other input sources: a control lever 54 and an operator interface 56. The control lever 54 provides manual control of the work implement 12. The control lever 54 may be implemented by a lever of conventional design such as one made by CTI Electronics of Bridgeport, Conn. The output of the control lever 54 determines the work implement 12 movement direction and velocity. The preferred implementation of the control lever coordinates the movements of the boom 16, stick 18 and bucket 20 to conform intuitively to the movement of the control lever 54.

A machine operator may enter excavation specifications such as excavation depth and floor slope through an operator interface 56 device. The interface 56 device may be implemented, for example, by a liquid crystal display screen with an alphanumeric key pad. A touch sensitive screen implementation is also suitable. The nature of operator input will be more apparent from the following discussions.

The position and force logic means 38 receives position and pressure signal inputs from the signal conditioner 52, manual control signals from the control lever 54, and operator input from the operator interface 56 and produces boom, stick and bucket cylinder correction command signals. The boom, stick and bucket cylinder correction command signals are delivered to actuating means including hydraulic control valves 57,58,59 for controlling hydraulic flow for respective boom, stick and bucket hydraulic cylinders 28,30,32.

From the foregoing several automatic excavation control options are available. Six control options are selectable by a machine operator to satisfy individual operator preferences or to tailor the automatic excavation control 10 to specific excavation requirements. Control options 1) and 2) are directed towards two bucket referencing methods in which the movement of the control lever 54 commands the movement of the bucket 20. Control option 3) is a force threshold logic control option that provides for monitoring of the forces on the work implement 12 to detect overloading and predict stalling. Control option 4) allows the machine operator to specify an excavation depth and slope. Control option 5) allows the operator to specify an area that the bucket is restricted from entering during excavation. Lastly, control option 6) is automatic excavation. Selecting this option allows the control system 10 to excavate by performing the work cycle automatically. A more detailed discussion of the automatic control system control options and the manner in which each option is implemented follows.

Figure 3:
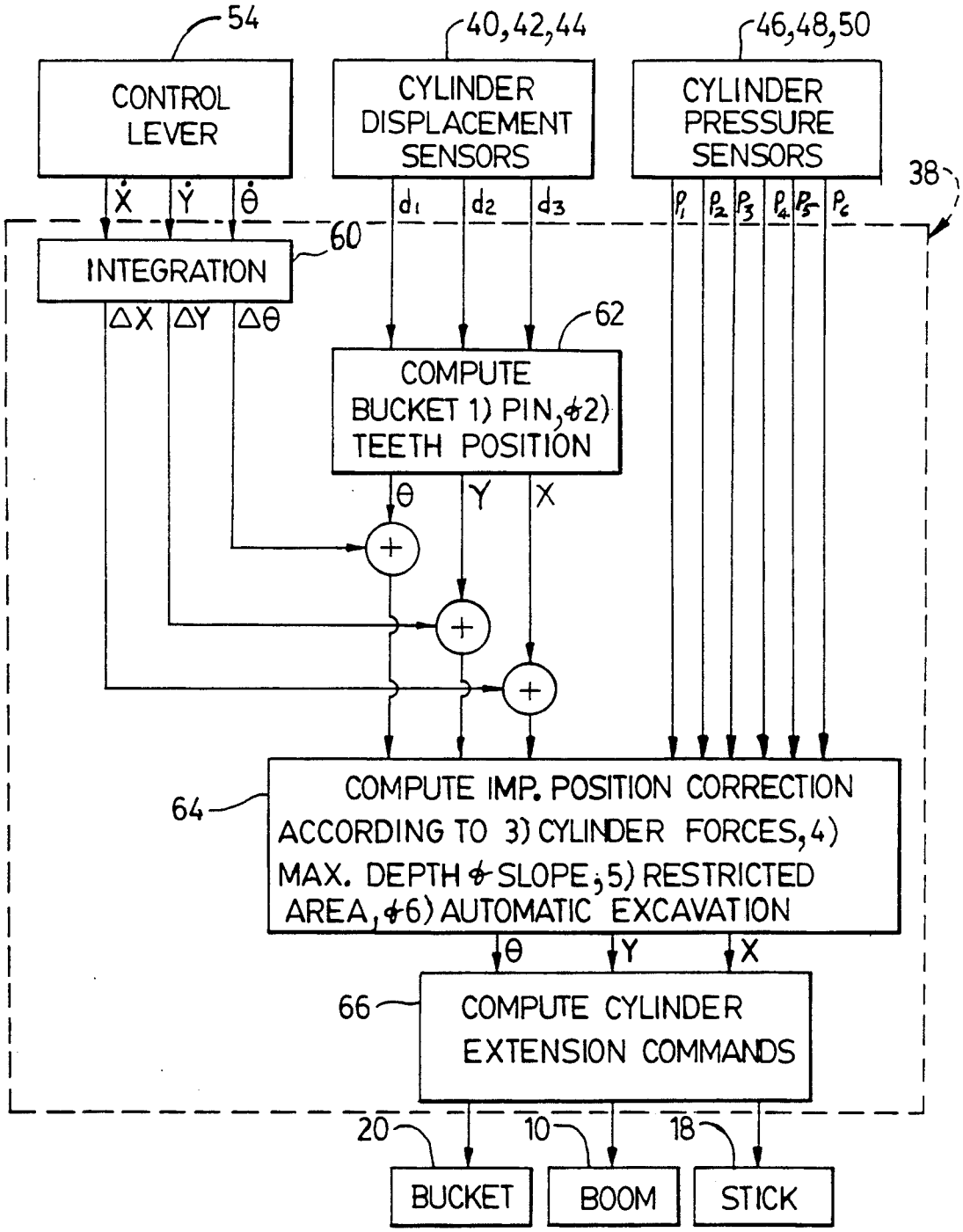
FIG. 3 is a functional block diagram of an embodiment of the instant invention.

Referring to FIG. 3, the position logic means 38 receives manual control velocity vectors X, Y and Θ from a control lever 54. The velocity vectors are integrated to obtain displacement ΔX, ΔY, ΔΘ desired in each horizontal, vertical and rotational axis, as shown in block 60. In addition, the position logic means 38 receives boom, stick, and bucket cylinder position signals d1–d3 from cylinder displacement sensors 40,42,44. A present bucket position is computed from the position signals.

In block 62, two options are available to compute the bucket position. Options 1) and 2) are bucket reference options which allow either the bucket pivot pin 34 or the bucket teeth 24 to be used as a control reference point. The main differences between the two bucket reference options 1) and 2) are how bucket position is calculated and how bucket movements are controlled.

In the bucket pivot pin reference option 1), the bucket cylinder extension is not used for calculating the bucket pivot pin position since the bucket angle Θ value is not required. The bucket pivotal motion is controlled in a normal manner, i.e. when the control lever 54 is manipulated to demand bucket curl, the bucket 20 is curled.

In the bucket teeth reference control option 2), the bucket angle Θ is coordinated with the horizontal and vertical X,Y movements of the work implement 12. As the bucket 20 is moved toward the excavating machine 14, rotation of the bucket 20 is required to maintain the bucket angle Θ. In this option, the bucket angle Θ is maintained without requiring additional manual adjustments, Option 2) facilitates applications where it is desirable to maintain the bucket teeth 24 on a plane at a given slope while keeping the same bucket angle Θ. When this option is selected, the boom, stick and bucket hydraulic cylinder extensions are used to calculate the horizontal, vertical and rotational X,Y,Θ components of bucket position.

A bucket pivot pin or bucket teeth position is computed from the boom, stick, and bucket position signals produced by respective cylinder displacement sensors 40,42,44 in block 62. The computed bucket position is then combined with the manual control displacement values ΔX, ΔY, ΔΘ to obtain a desired bucket position. In block 64, the desired bucket position is used to compute work implement position corrections in the X, Y and Θ axes according to current conditions and/or constraints depending on the control option(s) selected.

Option 3) is a force threshold logic control option. Cylinder pressure sensors 46,48,50 sense boom, stick and bucket hydraulic cylinder head and rod end pressures p1–p6. The force logic means 38 receives the pressure signals p1–p6 (through the signal conditioner 52, not shown in FIG. 3) and computes boom, stick and bucket cylinder forces. From sensed hydraulic pressure, the force exerted on a given cylinder, which equals the force exerted by that cylinder, may be calculated by the following formula:

$$cylinder\ force = (P_2 * A_2) - (P_1 * A_1)$$

where $P_2$ and $P_1$ are respective hydraulic pressures at the head and rod ends of a part of a particular cylinder 28,30,32, and $A_2$ and $A_1$ are cross-sectional areas at the respective ends. In FIG. 1, force vectors $F_1$, $F_2$, and $F_3$ on the boom, stick, and bucket hydraulic cylinders 28,30,32 indicate the direction of force exerted to cause extension of the respective hydraulic cylinder. Comparisons of the computed cylinder forces to predetermined force setpoints is used to detects boom, stick and bucket 16,18,20 overloading and predict stalling.

Another option shown in block 64 is the maximum depth and slope option. A maximum excavation depth with respect to the reference elevation can be specified by the machine operator. The vertical component Y of the desired bucket position is compared to the maximum depth specified when this option is selected. The automatic excavation control system 10 prevents the bucket 20 from digging below the specified depth, even if the work implement 12 is manually commanded to lower the bucket 20 past the maximum depth. Additionally, an angle may be specified by the operator for a sloped floor finish. The automatic excavation control system 10 calculates the desired change in the horizontal and vertical distances from the bucket's present position to achieve the specified slope. The automatic excavation control system 10 ensures that the lowest point of the sloped floor does not exceed the specified maximum depth.

Option 5) restricted area allows the operator to define a three dimensional area where entry of the bucket teeth 24 is forbidden, even if the work implement 12 is manually controlled to enter it. A restricted area is defined by a radius from a centerline generally perpendicular to the dig stroke of the excavating machine 14. The restricted area is specified by entering, using the operator interface 56, a horizontal distance from the boom pivot pin 22, a vertical distance below the reference elevation, and a radius. In computing work implement position corrections in the X, Y and Θ axes, the desired bucket position is compared to the restricted area coordinates. If the desired bucket position and the restricted area coincide, the control lever 54 inputs are modified to avoid the restricted area.

Option 6) is automatic excavation. An excavation work cycle, as defined by boom-down-into-trench, dig-stroke, capture-load, swing-to-dump, dump-load, and return-to-trench functions, is executed automatically. The manner in which this is accomplished will become more apparent from the discussions accompanying FIGS. 4–9 below.

In block 66, the work implement position corrections in the X, Y, and Θ axes produce work implement cylinder extension command signals. These command signals cause boom, stick and bucket hydraulic cylinder displacement.

Figure 4:
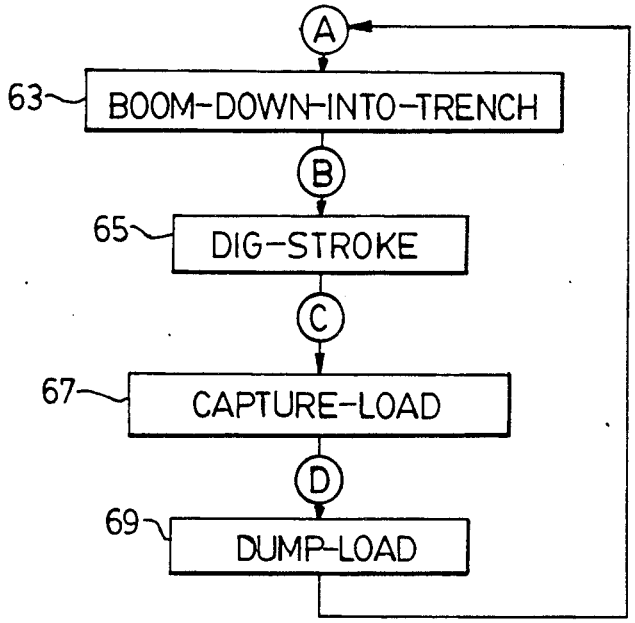
FIG. 4 is a top level flowchart of an embodiment of the instant invention.

Referring to FIG. 4, a top level flowchart of the automated excavation work cycle is shown. The work cycle for an excavating machine 14 can generally be partitioned into four distinctive and sequential functions: boom-down-into-trench 63, dig-stroke 65, capture-load 67, and dump-load 69. The dump-load 69 function includes swing-to-trench and return-to-trench functions as discussed below. As the flowchart shows, the automated excavation work cycle is iteratively performed. Operator intervention is not required to perform the work cycle, although the operator may modify the work implement 12 movement when the modification does not contradict maximum depth or restricted area specifications.

Figure 5:
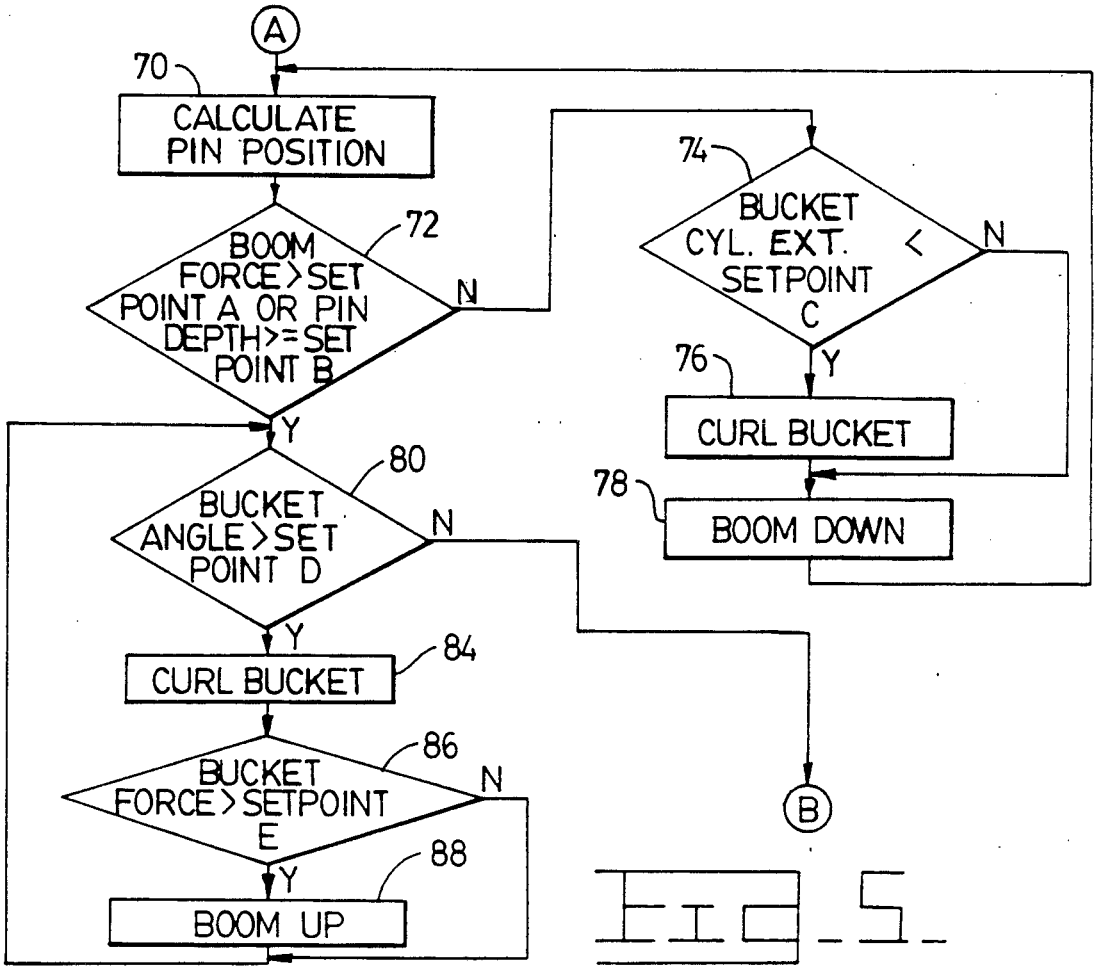
FIG. 5 is a second level flowchart illustrating an embodiment of the boom-down-into-trench function.

In FIG. 5, the boom-down-into-trench function 63 positions the work implement 12 so that the bucket 20 is at an optimal starting depth and cutting angle. The function begins by calculating the bucket pivot pin position as shown in block 70. Hereafter the term "bucket position" refers to bucket pivot pin displacement in the horizontal and vertical directions from the boom pivot pin 22, together with the bucket angle Θ, as shown in FIG. 1. In decision block 72, the boom cylinder force $F_1$ is computed and compared to a setpoint A. Setpoint A is defined as a force value just less than the force that must be exerted on the boom to begin lifting the machine 14 off the ground with the boom, stick and bucket 16,18,20 extended outwardly. The bucket pivot pin 34 depth is compared to a setpoint B, which is the pin depth at the maximum dig depth as specified by the machine operator.

If the boom force $F_1$ is not greater than setpoint A and the pin depth is not greater than or equal to setpoint B, then the bucket cylinder extension is compared to a setpoint C in block 74. Setpoint: C corresponds to the bucket cylinder extension which does not allow the bucket 20 to "heel." "Heeling" occurs when the rounded portion 26 of the bucket 20 makes contact with the soil, greatly reducing cutting efficiency. If the bucket cylinder extension is less than setpoint C, then the bucket 20 is curled to decrease the bucket angle Θ in block 76, the boom 16 is extended down further into the ground in block 78, and the program execution continues at block 70. If the bucket cylinder extension is not less than setpoint C, then the boom is moved down in block 78 without curling the bucket 20, and execution returns to block 70. Thus, as long as the force $F_1$ on the boom 16 is such that the vehicle 14 will not tip, and the bucket 20 does not exceed maximum depth, the control system 10 keeps lowering the boom 16 while making sure that the bucket 20 is not "heeling."

If, in decision block 72, the comparison between the boom cylinder force and setpoint A indicates that the vehicle may begin to tip or the bucket exceeds the maximum depth, then the bucket or cutting angle Θ is compared to a setpoint D in block 80. Setpoint D is a predetermined cutting angle of the bucket. If the bucket angle Θ is greater than setpoint D, the bucket is curled in block 84 to achieve a better cutting angle. Thereafter decision block 86 is executed to compare the bucket cylinder force $F_3$ with a setpoint E, which is the bucket cylinder force just less than the amount of force which will begin to cause the machine 14 to slide when the boom cylinder force $F_1$ is at setpoint A. If the measured bucket cylinder force $F_3$ is greater than the setpoint E, the boom 16 is moved up in block 88 to reduce the force and program control returns to block 80, where the bucket angle Θ is compared to a setpoint D. If the bucket force $F_3$ is not greater than the setpoint E, the program proceeds directly to block 80, bypassing block 88. If the bucket angle Θ is less than or equal to the setpoint D, program execution proceeds to section B of the flowchart (FIG. 6), else the code corresponding to block 84, 86, and 88 is executed again. It is apparent from the foregoing that during boom-down-into-trench 63 functions, the work implement 12 is positioned so that the bucket depth and the cutting angle Θ are adjusted to be ready for digging.

In FIG. 6, the dig-stroke function 65 moves the work implement 12 along a dig path toward the excavating machine 14. The dig-stroke function 65 begins by calculating the bucket pivot pin position in block 90. The stick cylinder extension and the bucket cylinder extension are compared to a setpoint F and a setpoint G respectively in block 92. Setpoints F and G are indicators for dig-stroke completion. The excavating machine 14 performs the dig-stroke portion of the work cycle by bringing the bucket 20 toward the excavating machine 14 until the stick 18 is nearly fully retracted. Setpoint F is the stick cylinder extension when the stick cylinder 30 is near maximum extension, i.e. when the stick 18 has been brought near the excavating machine 14. Similarly, as the stick cylinder 30 is being extended, the bucket cylinder 32 is being retracted to maintain the bucket angle Θ. Setpoint G is the bucket cylinder extension when the cylinder 32 is nearly fully retracted, indicating the end of the digging stroke.

If either cylinder extension exceeds the respective setpoint, the digging stroke is complete, and the program proceeds to section C of the flowchart (FIG. 7) where the machine 14 may begin to capture load. If neither of the above conditions is true, in block 94 the forces $F_1$, $F_2$, $F_3$ exerted on the boom, stick and bucket cylinders 28,30,32 are checked against maximum rated cylinder forces as specified by the machine manufacturer. This step prevents overloading of the machine hydraulic system that may cause stalling. If the measured cylinder forces $F_1$, $F_2$, $F_3$ exceed a predetermined maximum force, the boom 16 is raised in block 96 to relieve the excess force. In the present embodiment, the setpoints are approximately 85% of the maximum rated force.

If excessive force is not detected in block 94, the stick cylinder extension is compared to a setpoint H and the bucket cylinder force $F_3$ is compared to a setpoint I in block 98. If the stick cylinder extension is less than setpoint H and the bucket cylinder force $F_3$ is greater than setpoint I, the work implement 12 is not in a strong digging position. The work implement 12 at this time is like a long moment arm, and the tendency for the machine to begin to tip and/or slide is great.

In this situation the boom 16 is raised in block 100 to reduce the bucket force $F_3$. The boom cylinder force $F_1$ is then compared to a setpoint L in block 102. The purpose of this comparison is to ensure that the machine 14 does not lift up off the ground given the work implement geometry. If the force $F_1$ is less than setpoint L, the stick 18 is extended outward in block 104 to relieve the force and program control proceeds to block 116.

If the undesirable condition in block 98 is not found, then the bucket pivot pin depth is compared in block 106 to see if it is greater than or equal to setpoint. B, which is the maximum dig depth. If the bucket 20 is at the maximum depth, the bucket 20 is moved horizontally toward the machine 14 in block 108, after which the program proceeds to block 116, discussed below. If the bucket 20 is not at maximum depth, the stick cylinder force $F_2$ is compared to a setpoint J. If the stick cylinder force $F_2$ is less than setpoint J, the bucket 20 is not digging effectively. To correct the situation, the stick 18 is brought closer to the machine 14 without moving the boom 16 to increase the depth of cut, shown in block 112. Otherwise the bucket pivot pin 34 is moved horizontally toward the machine 14 in block 114. Note that to move the bucket pivot pin 34 horizontally, the boom 16 and stick 18 movements are coordinated to maintain the elevation of the bucket pivot pin 34.

The program next progresses to block 116 where operator adjustments of the control lever 54 are used to move the work implement 12 according to the operator commands unless his commands contradict the specified maximum depth, restricted area and/or slope. The operator input may be configured in the bucket pivot pin or bucket teeth referencing options 1), 2).

Thereafter, the bucket coordinate X is compared to a setpoint K, which is the horizontal distance between the boom pivot pin 22 and the bucket pivot pin 34 when much of the dig stroke is complete. If the distance between the pins 22, 34 is less than the setpoint K, the bucket 20 is curled to begin capturing the load and control is returned to block 90.

Figure 7:
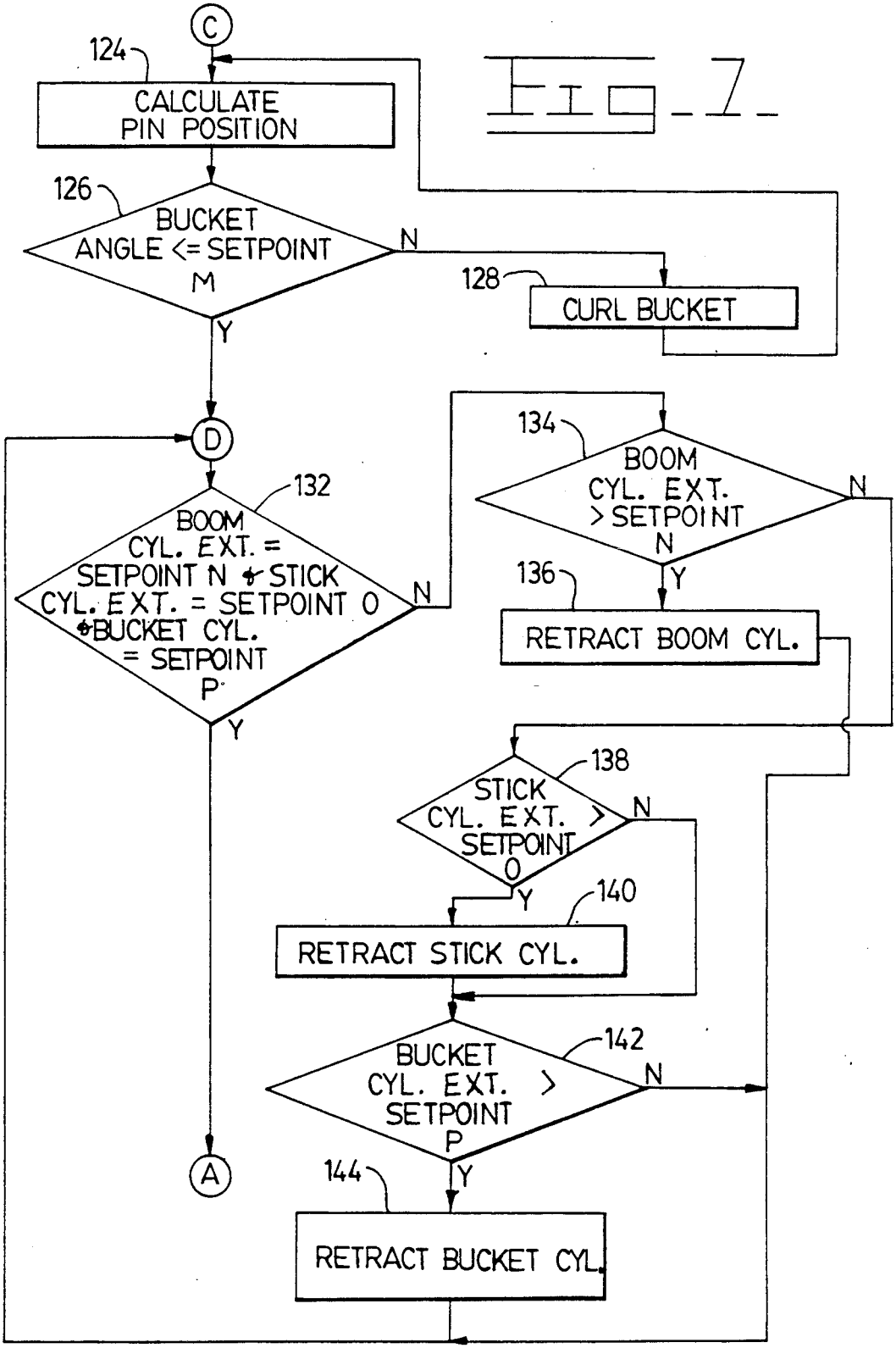
FIG. 7 is a second level flowchart illustrating an embodiment of the capture-load and dump-load functions.

The work implement 12 geometry eventually satisfies the conditions in block 92, indicating the completion of the dig stroke, and the control system 10 begins the capture-load function shown in FIG. 7.

FIG. 7 illustrates the logic for both the capture-load and dump-load functions 67,69. The capture-load function 67 begins by calculating the position of the bucket pivot pin 34 in block 124. The bucket angle $\Theta$ is compared to a setpoint M which is the bucket angle sufficient to maintain a heaped bucket load. If the present bucket angle $\Theta$ is greater than the setpoint M in block 126, the bucket 20 is further curled in block 128 until the bucket angle is less than or equal to the setpoint M, so that the the dump-load function may begin in section D.

At the beginning of the dump-load function 69, the boom, stick and bucket cylinder extensions are compared to setpoints N, 0, and P respectively in block 132 to determine whether the captured load has been fully dumped. The load is fully dumped when the boom 16 is raised, the stick 18 is extended outward, and the bucket 20 is inverted. Note that in this fully dumped position all the cylinders 28,30,32 are substantially fully retracted. If this position has not been reached, the boom, stick and bucket cylinder extensions are checked sequentially against setpoints N, O, and P as shown in blocks 134, 138 and 142, and each cylinder is retracted further if its extension is greater than the respective setpoint (in blocks 136, 140, 144). When each of the cylinders 28,30,32 is in the fully retracted position, the work cycle is repeated, and program control returns to the boom-down-into-trench function 63 in section A until the maximum dig depth is reached.

The discussion of the swing and return-to-trench functions has been postponed until last because it involves automating the work implement 12 in a different and separate fashion from the preceding functions.

Figure 8:
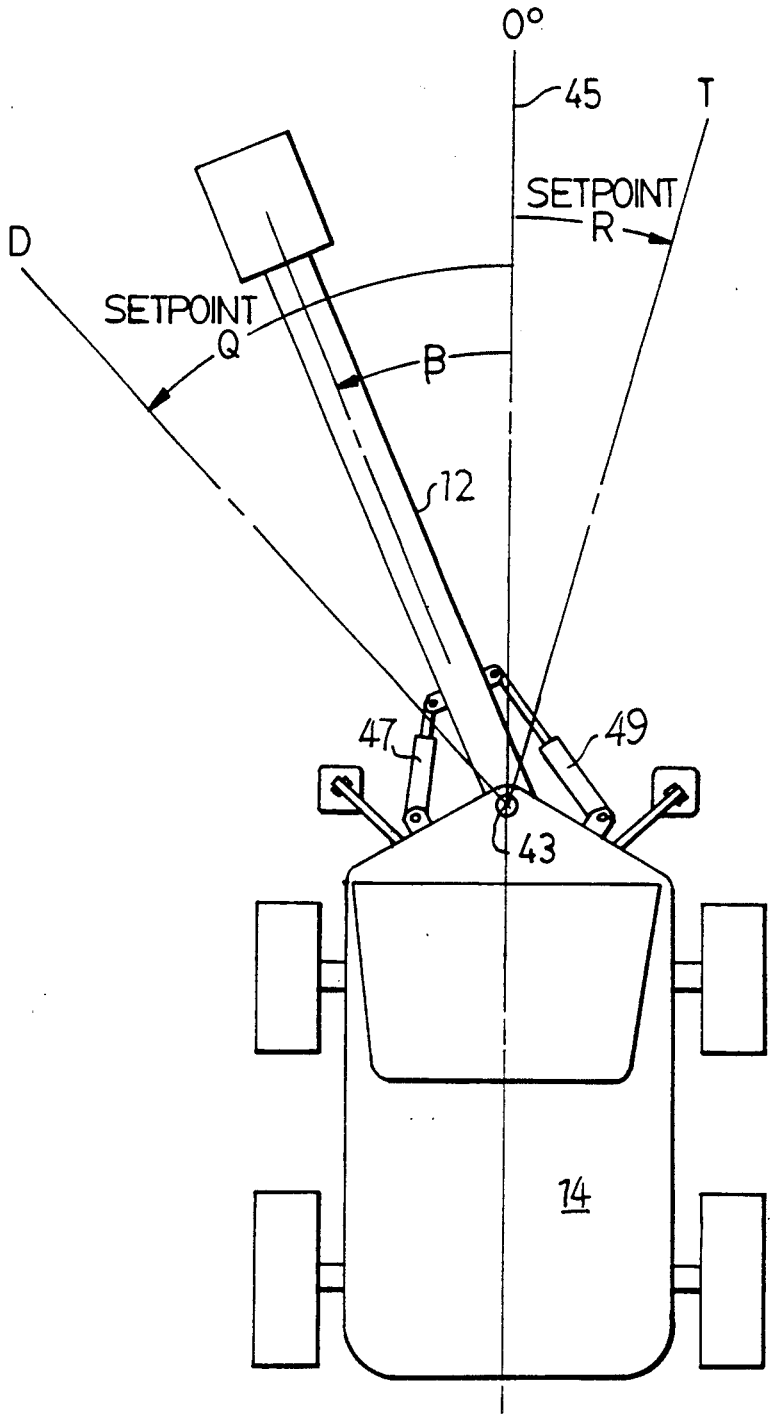
FIG. 8 is a top view of an excavating machine.

Referring to FIG. 8, the swing angle $\beta$ at an implement pivot point 43 is the transverse angle between the work implement 12 and the centerline 45 of the excavating machine 14. This swing angle $\beta$ is present in a backhoe where the work implement 12 swings independently of the vehicle body, and also an excavator or a power shovel where the operator cab is rotatable with the work implement 12. The swing angle $\beta$ is further defined to be positive counterclockwise from the longitudinal centerline 45 and negative clockwise from the centerline 45. Thus when the work implement 12 is in line with the longitudinal centerline 45, the swing angle $\beta$ is zero.

A swing angle sensor, such as a rotatory potentiometer, located at the work implement pivot point 43, produces an angle measurement corresponding to the amount of work implement deviation from the longitudinal centerline 45 of the machine 14. In an alternative embodiment, a hydraulic cylinder displacement sensor, such as those used on the boom, stick and bucket cylinders 28,30,32, positioned on one of the swing cylinders 47,49, is also suitable for measuring the work implement swing displacement. A swing angle may be computed from the measured cylinder extension.

Prior to starting the excavation work cycle, the dump and trench positions and the their respective transverse angles are specified and recorded. A trench angle may be set by positioning the work implement 12 at the trench position T. Similarly, the operator then swings the work implement 12 to a dump location D to establish a dump angle. The desired dump and trench angles are stored by the control system 10 as setpoints Q and R respectively to be used during the swing-to-dump and return-to-trench functions.

Referring to FIG. 9, the flowchart shown in FIG. 7 for the dump-load function 69 is modified to include the swing-to-dump and return-to-trench functions. In block 132, setpoint Q is compared to setpoint R to determine the positions of the dump and trench angles relative one to the other. If setpoint R (trench angle) is greater than setpoint Q (dump angle), a variable FLAG is set to equal zero in block 134. The variable FLAG is set to equal one otherwise in block 136. In block 138, the boom, stick and bucket cylinder extensions are compared to setpoints N, O, and P respectively to determine whether the fully dumped position has been attained. If the cylinder extensions are not simultaneously at these respective setpoints, then the work implement 12 is not in the fully dumped position and the program execution branches to blocks 140–160.

In block 140–160, the work implement hydraulic cylinders 28,30,32 are retracted to attain the fully dumped position and the work implement 12 is swung to the dump position D. The boom cylinder extension is first compared to a setpoint N in block 140. If the boom cylinder extension is greater than setpoint N, then the boom cylinder 28 is retracted in block 142. The boom cylinder comparison and retraction are performed until the boom cylinder is fully retracted, satisfying the condition in block 140. If in block 140, the comparison finds that the boom 16 is in a retracted and therefore raised position then the implement 12 is entirely above the top of the trench and the work implement 12 may begin to swing towards the dump position D.

In block 144, the variable FLAG is checked to determine which direction the work implement 12 is required to swing to reach the dump position D. If FLAG is not zero, then the work implement is required to swing counterclockwise from the trench position T to reach the dump position D, and clockwise otherwise. If FLAG is not zero in block 144, the swing angle $\beta$ is compared to setpoint Q in block 146, where setpoint Q the dump angle. If the swing angle $\beta$ is less than setpoint Q, the implement 12 is swung counterclockwise toward the dump position D in block 148. If the FLAG is equal to one in block 144, the swing angle $\beta$ is compared to setpoint Q in block 150 and the work implement 12 is swung clockwise toward the dump position D in block 152. The work implement 12 is swung either counterclockwise or clockwise until the dump position D is reached.

Subsequently, the stick cylinder extension is compared to a setpoint O in block 154 and the bucket cylinder extension is compared to a setpoint P in block 158. If either of the cylinder extensions is greater than the respective setpoint, the appropriate cylinder is retracted in blocks 156,160.

The major program loop beginning at block 138 and ending at block 160 is executed repeatedly until the conditions in block 138 are satisfied, which indicates that the load contained in the bucket 20 is dumped at the dump position D. At this time the work implement 12 is to return to the trench position T. In block 162, the variable FLAG is checked. If the FLAG is zero, and the swing angle $\beta$ is less than setpoint R in block 164, the work implement 12 is swung counterclockwise in block 166 until the trench position T is reached. If the FLAG is not zero in block 162, and the swing angle $\beta$ is greater than setpoint R in block 168, the work implement 12 is swung clockwise in block 170 until the trench position T is reached. When the swing angle $\beta$ equals the setpoint. R in blocks 164 or 168, the work implement 12 is in line with the trench position T, and the entire work cycle may be repeated by returning the program execution to section A.

In the preferred embodiment of the swing-to-dump and return-to-trench functions, the work implement 12 is required to begin swinging toward the dump position as soon as it clears the top of the trench, much like the way an operator controls an excavating machine. The automatic excavation system 10 may automate the swing-to-dump and return-to-trench functions as described above and provide the operator the option of selecting either the automatic swing-to-dump and return-to-trench functions or manual swinging of the work implement 12.

The values for setpoints A through R shown in FIGS. 5–9 are machine dependent and may be determined with routine experimentation by those skilled in the art of vehicle dynamics, and by those familiar with machine capacities and dimensions.

INDUSTRIAL APPLICABILITY

The operation of the automatic excavation control system 10 is best described in relation to its use in earthmoving vehicles, such as excavators, backhoes, and front shovels. These vehicles typically include work implements with two or more linkages capable of several degrees of movement.

In an embodiment of the present invention, the excavating machine operator has at his disposal two work implement control levers and an automatic excavation control panel interface 56. Preferably, one of the two levers controls the implement movement in one vertical plane extending from the pivot point 22 of the boom 16 to the tip of the bucket 20, the other lever controls the side swing movement of the work implement 12 to another vertical plane at a pivotal angle from the first plane. The automatic excavation control panel interface 56 provides for operator selection of operation options and entry of function specifications.

Six control options are available: 1) bucket pivot pin reference, 2) bucket teeth reference, 3) cylinder force threshold logic, 4) maximum excavation depth and sloped floor, 5) restricted area, and 6) autonomous excavation. The operator selects among the control options one suited to the present excavation application or to personal preference.

Option 1) coordinates the movement of the bucket pivot pin 34 with the movement of the control lever 54, and all computation uses the bucket pivot pin 34 as the reference point. This option coincides with the natural expectation and operational practice of most operators.

Option 2) also coordinates movement between the bucket and the control lever 54, except the reference point is the bucket teeth 24. In option 2) the bucket angle is incorporated into the calculations. For example, if a horizontal movement is desired as in a floor finishing application, the control system automatically coordinates the boom, stick and bucket cylinders to move the bucket teeth along the horizontal line.

Option 3) force threshold logic allows automatic anticipation of potential stall conditions and provides corrective action before the stall condition occurs. The operator is prompted to choose either option 1) or 2) bucket reference options when option 3) is selected.

In selecting option 4) the operator is able to program the control system 10 a maximum dig depth and a slope of the digging path. The automatic excavation control 10 first prompts the operator through the operator interface 56 for the desired bucket reference option 1) or 2) and whether option 3) force threshold logic is to be activated. The operator is then prompted to maneuver the work implement 12 so that the bucket teeth 24 contacts the tip of the reference elevation stake 37. When this is accomplished, the operator enters a key stroke to indicate that the reference elevation has been located. The control system 10 then prompts the operator for the desired trench depth with respect to the reference elevation, and a desired slope. The operator enters a depth and may enter a zero slope for a level floor. The control system 10, after receiving the prompted operator inputs, calculates the coordinates of the desired excavation floor with respect to the excavation machine 14. The control system 10 will not allow the work implement 12 to pass below the excavation boundary formed by the floor depth and slope. During excavation, the operator has manual control of the work implement 12 and may excavate the material in any manner he desires. The control system 10 will not permit the bucket 20 to excavate material below the desired depth, thereby resulting in a smooth floor at the accurate depth and slope.

Option 5) restricted area is similar to option 4) but additionally provides the ability to designate restricted areas where the implement is not allowed to enter. This important option finds frequent application during excavating locations where pipe, utility lines, etc. are known to be buried. When control option 5) is selected, the operator is prompted to enter the trench depth and slope information as in option 4) in addition to information about the restricted area. The excavating machine 14 is positioned so that the longitudinal axis of the restricted area is substantially perpendicular to the longitudinal centerline 45 of the machine 14. The operator is prompted to enter a horizontal and vertical distance from the boom pivot pin 22 to the the restricted area longitudinal axis. Then the operator is prompted to enter a radial distance from the restricted area longitudinal axis. The longitudinal axis and the radius defines the confines of the restricted area. The operator is then able to excavate the material without concern for disrupting any utility line that lie within the restricted area.

Finally, in selecting control option 6), the excavating machine 14 has the ability to excavate autonomously. The excavating work cycle is automatically performed until the desired trench depth and slope has been reached. The control system 10 monitors work implement position and hydraulic cylinder pressures and acts and reacts according to prescribed position and force logic developed from an analysis of expert operator techniques.

For the autonomous excavation operation mode the operator is again prompted for a bucket reference option selection, for a desired dig depth and floor slope, and to contact the reference elevation stake to establish a reference elevation. Control option 3) force threshold logic is activated automatically in the automatic excavation option. If the trench position T deviates from the centerline 45 of the excavating machine 14, then the operator must position the work implement 12 at the trench site T to establish the trench angle. The operator is also prompted in like manner for the dump angle. The automatic excavation control system 10, under option 6), performs the work cycle and excavates material until the desired floor slope and depth is reached. Although the excavation is performed autonomously, operator adjustments may be made to the digging path via the control lever 54.

Other aspects, objects, and advantages of this invention can be obtained from a study of the drawings, the disclosure, and the appended claims.

I claim:

1. A control system for automatically controlling a work implement of an excavating machine throughout a machine work cycle, wherein said work implement includes a boom, stick and bucket, each being controllably actuated by at least one respective hydraulic cylinder, said hydraulic cylinders containing pressurized hydraulic fluid, each said hydraulic cylinder having a movable portion extendable between a first retracted position and a plurality of second positions in response to the pressure of hydraulic fluid contained therein, said control system comprising:

means for producing respective position signals in response to the position of each of said boom, stick and bucket;

position logic means for receiving said position signals, comparing each of said received position signals to a plurality of predetermined position setpoints, and producing a respective responsive position correction signal;

means for producing respective pressure signals in response to the hydraulic fluid pressure of each of said boom, stick and bucket hydraulic cylinders;

force logic means for receiving said pressure signals and responsively computing a correlative force signal for each of said boom, stick and bucket hydraulic cylinders and for comparing each of said correlative force signals with a plurality of predetermined force setpoints thereto, and delivering a respective responsive for correction signal; and actuating means for receiving said position and force correction signals, and controllably actuating said work implement to perform said work cycle in response thereto.

2. A control system, as set forth in claim 1, wherein said position logic means periodically compares at least one of said received boom, stick and bucket position signals to a predetermined one of said plurality of position setpoints and responsively produces a position correction signal in response to said one position signal being not equal to said one predetermined position setpoint, and said actuating means controllably moves said work implement in response to the presence of said position correction signal.

3. A control system, as set forth in claim 2, wherein said force logic means periodically compares at least one of said computed boom, stick and bucket force signals to a predetermined one of said plurality of force setpoints and responsively produces a force correction signal in response to said force signal being not equal to said predetermined force setpoint, and said actuating means controllably moves said work implement to modify the force exerted thereon in response to the presence of said force correction signal.

4. A control system, as set forth in claim 1, wherein said force logic means produces a force limit signal in response to any of said computed boom, stick and bucket force signals being greater than or equal to predetermined respective boom, stick and bucket maximum rated force setpoints, and said actuating means controllably moves said work implement upward in response to the presence of said force limit signal.

5. A control system, as set forth in claim 1, wherein said force logic means produces a force correction signal in response to said computed boom force signal being greater than a predetermined maximum boom downward force setpoint and said computed bucket force signal being greater than a predetermined bucket force setpoint, whereby a combination of said computed boom and bucket forces indicates that said combination is sufficient to cause said excavating machine to slide, and said actuating means controllably moves said work implement upward in response to the presence of said force correction signal.

6. A control system, as set forth in claim 1, wherein said force logic means produces a force correction signal in response to said computed stick force signal being less than or equal to a predetermined minimum dig force setpoint, and said actuating means controllably moves said work implement downward in response to the presence of said force correction signal.

7. A control system, as set forth in claim 1, wherein said position logic means produces a position limit signal in response to said received stick position signal being greater than a predetermined maximum stick-retracted position setpoint, and said actuating means controllably moves said work implement substantially horizontally toward said excavating machine in response to the absence of said position limit signal.

8. A control system, as set forth in claim 1, wherein said position logic means produces a position limit signal in response to said received bucket position signal being greater than a predetermined maximum bucket-curl position setpoint, and said actuating means controllably moves said work implement substantially horizontally toward said excavating machine in response to the absence of said position limit signal.

9. A control system, as set forth in claim 1, wherein said position logic means produces a position correction signal in response to said received stick position signal being greater than a predetermined stick-extended position setpoint, and to said computed bucket force being greater than a predetermined bucket dig force setpoint, whereby a combination of said receiving stick position signal and said computed bucket force indicates a weak work implement digging geometry, and said actuating means controllably moves said work implement upward in response to the presence of both of said position correction and force signals.

10. A control system, as set forth in claim 1, wherein said force logic means produces a force correction signal in response to said computed boom force being greater than a predetermined vehicle-tip force setpoint, and said actuating means controllably moves said work implement to decrease the force exerted on said work implement in response to the presence of said force correction signal.

11. A control system, as set forth in claim 1, wherein said position logic means produces a position limit signal in response to said received boom position signal being greater than or equal to a predetermined maximum boom-up position setpoint, and said actuating means controllably moves said boom upward in response to the absence of said position limit signal.

12. A control system, as set forth in claim 11, wherein said position logic means produces a position limit signal in response to said received stick position signal being greater than or equal to a predetermined maximum stick-extended position setpoint, and said actuating means controllably moves said stick outwardly from said excavating machine in response to the absence of said position limit signal.

13. A control system, as set forth in claim 12, wherein said position logic means produces a position limit signal in response to said received bucket position signal being less than or equal to a predetermined bucket-dump position setpoint, and said actuating means controllably pivotally moves said bucket outwardly from said excavating machine in response to the absence of said position limit signal.

14. A control system, as set forth in claim 1, wherein said position logic means produces a position correction signal in response to said received bucket position being not equal to a predetermined optimum bucket cutting angle position setpoint, and said actuating means controllably pivots said bucket in response to the presence of said position correction signal.

15. A control system, as set forth in claim 1, wherein said position logic means produces a position correction signal in response to said received bucket position being less than a predetermined bucket capture-load position setpoint, and said actuating means controllably pivots said bucket in response to the presence of said position correction signal.

16. A control system, as set forth in claim 1, wherein said work implement is further transversely moveable about a pivot, said position signal producing means further produces a position signal in response to said work implement transverse position, said position logic means produces a position limit signal in response to said received position signal being not equal to a predetermined transverse position setpoint, and said actuating means controllably moves said work implement transversely in response to the absence of said position limit signal.

17. A control system, as set forth in claim 1, wherein said position signal producing means produces said boom, stick and bucket position signals in response to the amount of extension of said respective actuating hydraulic cylinders.

18. A control system, as set forth in claim 1, wherein said position signal producing means computes a relative bucket position signal in response collectively to the amount of extension of said boom, stick and bucket hydraulic cylinders.

19. A control system, as set forth in claim 18, wherein said position logic means produces a position limit signal in response to the vertical component of said computed relative bucket position being greater than or equal to a predetermined maximum trench depth position setpoint, said force logic means produces a force limit signal in response to said computed boom force being greater than or equal to a predetermined maximum downward force setpoint, and said actuating means controllably moves said work implement downward in response to the absence of both of said position and force limit signals.

20. A control system, as set forth in claim 18, wherein said position logic means produces a position limit signal in response to the horizontal component of said computed relative bucket position being less than or equal to a predetermined minimum horizontal implement-to-machine distance position setpoint, and said actuating means controllably moves said work implement substantially horizontally toward said excavating machine in response to the absence of said position limit signal.

21. A control system, as set fourth in claim 18, wherein said position logic means produces a position limit signal in response to the horizontal component of said computed relative bucket position signal being equal to a predetermined range of position setpoints, and said actuating means controllably moves said work implement substantially horizontally toward said excavating machine in response to the absence of said position limit signal.

22. A control system, as set forth in claim 18, wherein said position logic means produces a position limit signal in response to the vertical component of said computed relative bucket position being equal to a predetermined range of position setpoints, and said actuating means controllably moves said work implement downward in response to the absence of said position limit signal.

23. A control system, as set forth in claim 18, wherein said position logic means produces a position correction signal in response to said computed relative bucket position and a predetermined desired trench slope, and said actuating means controllably moves said work implement vertically and horizontally in response to the presence of said position correction signal.

24. A control system, as set forth in claim 1, further comprising a control lever being adapted for manual control of said work implement and producing a manual position control signal, said position logic means receiving said manual position control signal and responsively producing a position correction signal in response thereto, and said actuating means controllably moving said work implement in response to said position correction signal.

25. A control system for automatically controlling a work implement of an excavating machine throughout a machine work cycle, said work implement including at least two linkages, each linkage being controllably actuated by at least one hydraulic cylinder, each said hydraulic cylinder containing pressurized hydraulic fluid and having a movable portion extendable between a first retracted position and a plurality of second positions in response to the pressure of hydraulic fluid therein, comprising:

means for producing respective position signals in response to the position of each of said linkages;

position logic means for receiving said position signals, comparing each of said received position signals to a plurality of predetermined position setpoints, and producing a responsive position correction signal;

means for producing respective pressure signals in response to the hydraulic pressure of each of said hydraulic cylinders;

force logic means for receiving said pressure signal, and responsively computing a correlative force signal for each of said hydraulic cylinders, and for comparing each of said correlative force signals to a plurality of predetermined force setpoints, and responsively delivering a force correction signal; and actuating means for receiving said position and force correction signals, and controllably actuating said at least two linkages of said work implement to perform said work cycle in response thereto.

26. A control system, as set forth in claim 25, wherein said work implement includes a third linkage, said third linkage being controllably actuated by a third hydraulic cylinder and including a control lever being adapted for manual control of said third linkage.

27. A control system, as set forth in claim 25, wherein said work implement is further transversely moveable about a pivot, said position signal producing means includes means for producing a position limit signal in response to one of said received position signals not being equal to a predetermined transverse position setpoint, and said actuating means includes means for controllable moving said work implement transversely in response to the absence of said position limit signal.

28. A control system, as set forth in claim 25, including a control lever being adapted for manual control of said work implement and producing a manual position control signal, said position logic means includes means for receiving said manual position control signal and responsively producing a manual position correction signal, and said actuating means includes means for controllably moving said work implement in response to said manual position correction signal.

* * * * *